US005098321A

United States Patent [19]

Taylor, Jr.

[11] Patent Number: 5,098,321

[45] Date of Patent: Mar. 24, 1992

[54] HIGH PERFORMANCE BOAT PROP GUARD WITH HIGH STRENGTH ATTACHMENT BRACKET

[76] Inventor: Guy Taylor, Jr., P.O. Box 164, Duchesne, Utah 84021

[21] Appl. No.: 586,416

[22] Filed: Sep. 21, 1990

[51] Int. Cl.[5] ..... B63H 1/16

[52] U.S. Cl. ..... 440/67; 440/900; 440/70

[58] Field of Search ..... 440/38, 66, 67, 71, 440/72, 900; 416/245 a, 247 a

[56] References Cited

U.S. PATENT DOCUMENTS

| | | | |
|---|---|---|---|
| 3,508,517 | 4/1970 | Hannan | 440/67 |
| 3,658,028 | 4/1972 | Koons | 440/67 |
| 3,899,992 | 8/1975 | Fuller | 440/67 X |
| 4,240,251 | 12/1980 | Fuller | 440/71 X |

FOREIGN PATENT DOCUMENTS

| | | | |
|---|---|---|---|
| 2213788 | 8/1989 | United Kingdom | 440/71 |

*Primary Examiner*—Edwin L. Swinehart
*Attorney, Agent, or Firm*—Gene B. Kartchner

[57] ABSTRACT

A propeller guard including a cylindrically shaped ring which includes a plurality of evenly spaced openings therethrough. The openings in the ring are formed so as to allow water to pass therethrough during operation so as to improve the performance characteristics, specifically acceleration, plaining, speed and steering, of the motor. The ring is attached to the motor by an attachment bracket which is designed to inhibit fatigue and cyclical loading failure caused by vibrations of the ring during use. The ring is formed in a generally tapered recangular cross section in order to minimize the drag and vibration characteristics thereof during use. The ring is formed so as to be attachable to an outboard motor to surround the propeller thereof to protect the propeller from underwater objects.

4 Claims, 2 Drawing Sheets

HIGH PERFORMANCE BOAT PROP GUARD WITH HIGH STRENGTH ATTACHMENT BRACKET

BACKGROUND OF THE INVENTION

1) Field of the Invention

The present invention relates generally to guard members for shielding the propeller of an outboard motor. More specifically, the present invention relates to a propeller guard which is designed for maximizing the performance of an outboard motor having a propeller guard attached thereto, and maximizing the strength and performance characteristics of the bracket which attaches the guard to the motor.

2) Prior Art

The propeller of an outboard motor typically rests below the bottom surface of the boat when in use, and propels the boat through the water. Due to its position during operation, the propeller of as outboard motor tends to be very susceptible to damage from under water objects such an rocks, sandbars, marine life and the like. If the propeller of the outboard motor becomes damaged due to its impingement on underwater objects, it may become unable to perform as designed. The need for repair and/or replacement of a propeller damaged thus, generally occurs at very inconvenient times and is always a very expensive repair. Therefore, a need exists to develope a device which can protect the propeller of an outboard motor to prevent its being damaged by underwater objects.

Also, the propeller of an outboard motor spins at an extremely high RPM during use. Should a passenger, skier, swimmer or other person be accidentally hit by the propeller during operation of the motor, serious injury will inevitably result. Therefore, a guard which will inhibit accidental contact of a person with the propeller to prevent accidental bodily injury is also needed.

Many prior art attempts have been made to solve the above problems. Several prior art devices which are representative of the many previous attempts to develope a prop guard responding to the above identified needs are shown in U.S. Pat. No. 2,551,371 to Grieg; U.S. Pat. No. 2,963,000 to Fester; U.S. Pat. No. 2,983,246 to Manley; and, U.S. Pat. No. 4,078,516 to Balius. In each of these devices an enclosure, generally including a hollow cylindrical member, is attached to the outboard motor so as to surround the propeller. The device is designed to allow water to have fluid flow access to the propeller in order to allow the propeller to function as designed. Although these devices are somewhat successful in preventing damage to the propeller by preventing contact of the propeller with underwater objects, several severe drawbacks nevertheless remain. Most importantly, each of these devices tend to severely reduce the performance characteristics of the outboard motor.

As is well understood, an outboard motor pushes a boat forward in reaction to the propellers of the motor forcing water backwards. However, an outboard motor which also includes a propeller guard is inhibited in its performance due to the fact that water flowing past the propeller tends to be dispersed and/or disrupted by the guard. Also, water impinging on the guard during operation of the motor increases the drag characteristic thereof, thus decreasing performance. Further, the presence of the guard, since not necessarily designed as an integral part of the motor, can cause instability, vibrations, control degradation, and unpredictability of motor response during use. Finally, prior art propeller guards are attached to the motor in such a manner as to be incapable of preventing damage or failure of the attachment members during high speed use. Accordingly, it is needful that a propeller guard be developed and designed which affords protection against contact between the propeller and underwater objects, and which at the same time is designed so as to maintain or improve the performance characteristics, such as steering, top end speed, planing, acceleration, attachment bracket durability, etc. of the motor.

U.S. Pat. No. 4,680,017 to Eller, attempts to address the problem of maintaining and/or improving performance characteristics of the motor through the design a propeller guard. The propeller guard of the Eller invention functions to prevent radial dissipation of water passing through the propeller, to thereby cause all water to be directed in a linearly rearward direction as it passes through the propeller, so as to be useful in generating forward motion of the boat. However, in operation, the drag characteristics of Eller's propeller guard tend to off-set any advantages of its use. Further, control characteristics of Eller's motor are significantly degraded due to the presence and design of Eller's propeller guard.

OBJECTS AND SUMMARY OF THE INVENTION

It is a principle object of the present invention to provide a propeller guard for an outboard motor which can prevent inadvertent contact of underwater objects with the propeller thereof during use.

It is also a principle object of the present invention to provide a propeller guard which is designed to maintain or improve the performance characteristics of the motor. It is another object of the present invention to design a propeller guard attachment bracket which is not subject to failure due to forces thereon such as vibration or cyclical loading in the manner of prior art attachment brackets.

It is another object of the present invention to design a propeller guard which, improves the control characteristics such as planing, top speed, acceleration, and steering, etc. of the outboard motor.

It is further an object of the present invention to design a propeller guard which is simple to manufacture and therefore relatively inexpensive, yet durable and reliable in design.

These and other objects of the present invention are realized in a specific embodiment thereof which includes a generally cylindrical ring having diameter which is greater than the diameter of the propeller over which it is to be attached. The ring includes a small concave attachment plate at one position thereabout and an attachment bracket diametrically opposed thereto. The attachment plate and bracket allow the ring to be securely attached to the outboard motor at the bottom of the anti ventilation fin and the lower fin of the motor respectively. The ring includes a series of openings therethrough which allow the water passing over the exterior of the ring to be diverted through the openings by vacuum force, from the exterior of the ring to the interior thereof, as the guard passes through the water. The openings are oriented around the ring in a generally uniform manner and are formed through the ring in a manner which causes the water passing therethrough to be given a slight radial component of flow directed directly toward the propeller in order to give increased control (specifically steering), to the motor. The size, number and general distribution of the holes about the ring are calculated to allow sufficient radial flow of water to allow precise control and steerability of the motor, while avoiding problems due to flow blockage during a sharp turn which moves the ring into blocking relationship with water moving past the propeller. The ring is formed with a tapper in the interior side of the entrance opening and a similar tapper on the exterior side of the exit opening. The shape of the ring functions to diminish the drag and vibration characteristics of the guard while at the same time improving the controllability thereof by generating a vacuum through the openings in the sides of the ring which pulls water in toward the propeller. The attachment bracket of the invention secures the ring to the motor in a rigid and stable fashion and is designed to minimize vibrations and other cyclical loading thereon in order to prevent premature metal fatigue, cracking, or failure.

BRIEF DESCRIPTION OF THE DRAWING

FIGS. 4(*b*) and 4(*c*) are cross sectional views of FIG. 4 (*a*) with arrows showing water flow direction.

DETAILED DESCRIPTION OF THE INVENTION

Figure 2:
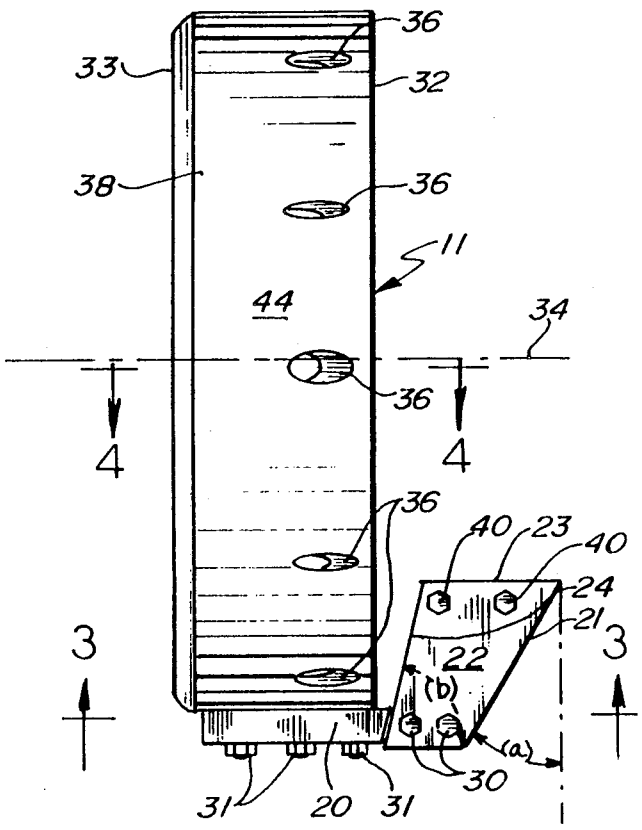
FIG. 2 is a side view of a propeller guard formed in accordance with the principles of the present invention.

The prop guard 10 of the present invention is adapted for use on motor boats having either an outboard motor 13 as shown in dashed lines in FIG. or may be used on an inboard/outboard motor (not shown). The motor includes a propeller 14 having blades 15 which is operatively connected inside motor 13 to a conventional type drive. The prop guard 10 of the present invention is attached to the motor 13 at a location on the underside of the cavitation plate 16 by an attachment plate 18 and is also attached to a lower fin 17 of the motor 13 by an attachment bracket 12.

Figure 1:
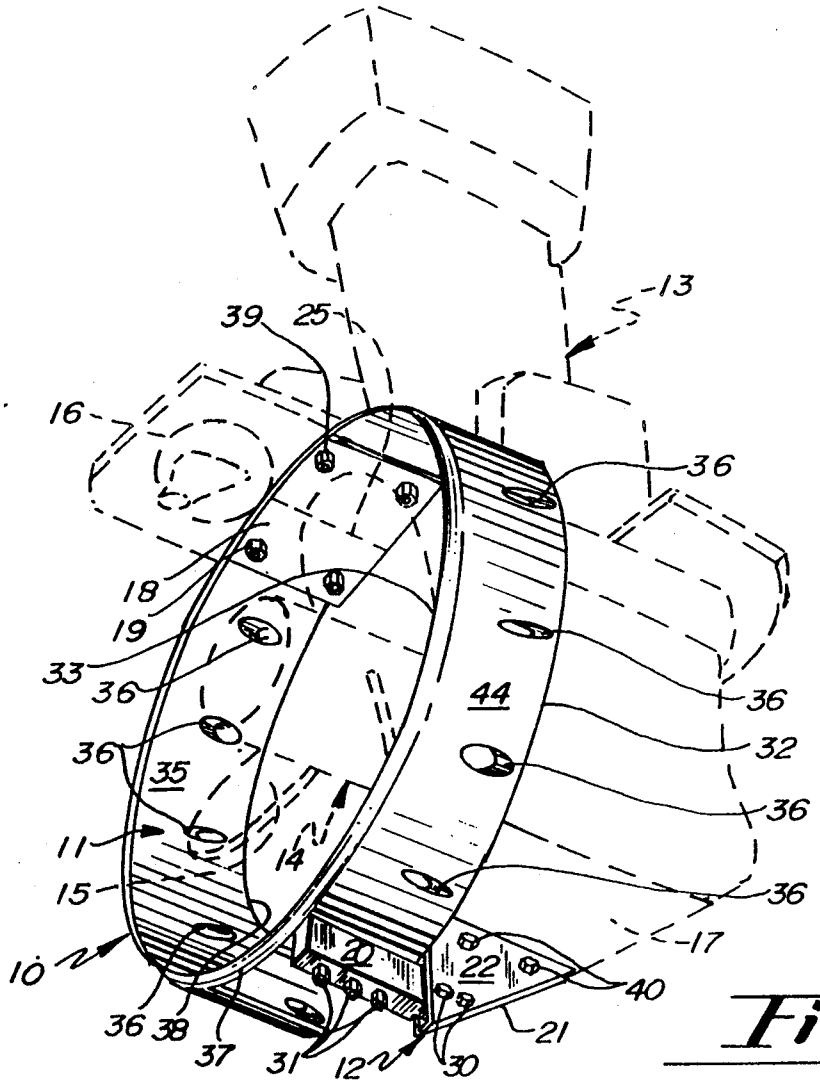
FIG. 1 is a perspective view of a propeller guard formed in accordance with the principles of the present invention, propeller guard being shown attached to an outboard motor (drawn in dashed lines)

As best seen in FIGS. 1 and 2, the prop guard 10 of the present invention is shown for purposes of the present disclosure as being attached to an 88-90 Merc and Mariner 100-115 hp outboard motor. It is well within the scope of the present invention however to attach the prop guard 10 to any sized or type of outboard or inboard-outboard motor. For the purposes of the following description however is should be understood that the particular dimensions identified relate to the above mentioned motor and therefore would likely be modified should the prop guard 10 be adapted for placement on other types or sizes of motors.

The propeller guard 10 is formed from a flat elongated rectangular section of metal which has been rolled into the shape of a circular ring shape 11. It is preferred that the metal be aluminum, and in the preferred embodiment of the invention the aluminum has a length of four feet, a width of four inches and a thickness of one quarter inch. When rolled into a circle, the diameter thereof is preferably seventeen and one quarter inches.

The attachment plate 18 is preferably formed of a similar aluminum having a length of approximately seven inches, a width of approximately four inches and a thickness of one quarter inch. The attachment plate is preferably formed with a slight (one quarter inch) inward bow formed centrally therein which corresponds to the curvature of the bottom of the cavitation plate 16 of the motor 13 to which it is to be attached.

The attachment plate 16 is drilled with four holes 19, each approximately 5/16ths inches in diameter and each located at a corner of the attachment plate 16 approximately three quarters of an inch in from each side forming each corner. The attachment plate 18 is then placed into the ring 11 and welded to each end thereof to form a complete continuous circumference. The plate 16 is formed in the ring so as to cause the bowed shape thereof to be directed inwardly into the interior of the ring 11. It should be noted that the entire ring may be cast if desired instead of cut and welded as described without departing from the spirit and scope of the invention.

Figure 3:
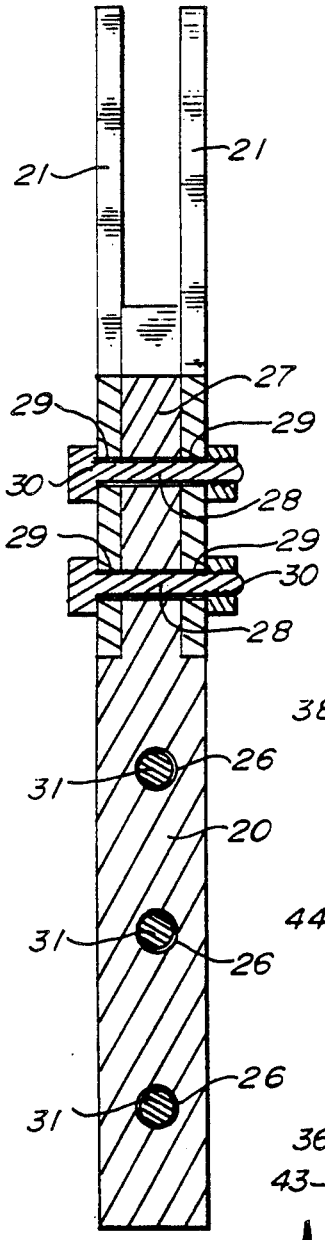
FIG. 3 is a cross sectional view of the attachment bracket of the present invention taken along line III—III of FIG. 1.

As best shown in FIGS. 2 and 3, the attachment bracket 12 is preferably formed of stainless steel, and in the embodiment of the present invention, is formed of T304 stainless steel. The attachment bracket 12 includes a generally flat, rectangular metal plate 20 preferably approximately seven inches long by one inch wide by one-half inch thick, and a pair of side plates 22. The side plates 22 are cut to form front edges 21 which are at an angle (a) of approximately 40 degrees with the top edges 23 thereof. In the preferred embodiment the angle (a) is approximately 38 degrees. The rear edge 24 of side plates 22 are cut to form an angle (b) of approximately sixty degrees with the bottom edge thereof and in the preferred embodiment the angle (b) is approximately sixty degrees.

The metal plate 20 is attached to the ring at a position diametrically opposed to the center line 25 of the attachment plate 18.

The plate 20 is formed with three holes 26 therein which are one quarter inch in diameter and which are evenly spaced along the length of plate 20 which contacts the ring 11. The plate 20 includes an extension 27 which is of a reduced thickness and which includes holes 28 of quarter inch diameter which correspond with holes 29 of the side plates 22 when the side plates are properly attached to the metal plate 20. Side plates 22 are attached to the metal plate 20 by mean of bolts 30 and metal plate 20 is attached to ream 11 by bolts 31.

As best shown in FIG. 2, ring 11 includes an entrance opening 32 and an exit opening 33 and a central longitudinal axis 34.

From center line 25 of attachment plate 18, proceeding in both directions around the interior surface 35 of the ring 11, ports 36 have been drilled through the ring 11 at four inch intervals around the entire circumference of the ring 11. The total preferred number of ports around the ring 11 of the particular embodiment shown is 10. Each port is centered approximately one and on quarter inches back from the inlet opening 32 of the ring 11. Each port is drilled through the ring 11 at an angle (c) of approximately 34 degrees from the central axis of the ring 11. It is preferred that the two ports 36 closest to attachment plate 18 be of a diameter of approximately seven tenths of an inch and formed at an angle (c) of approximately thirty four degrees, with the remaining ports 36 being of a diameter of approximately one-half inch and at an angle (c) of approximately twenty two degrees.

Figure 4B:
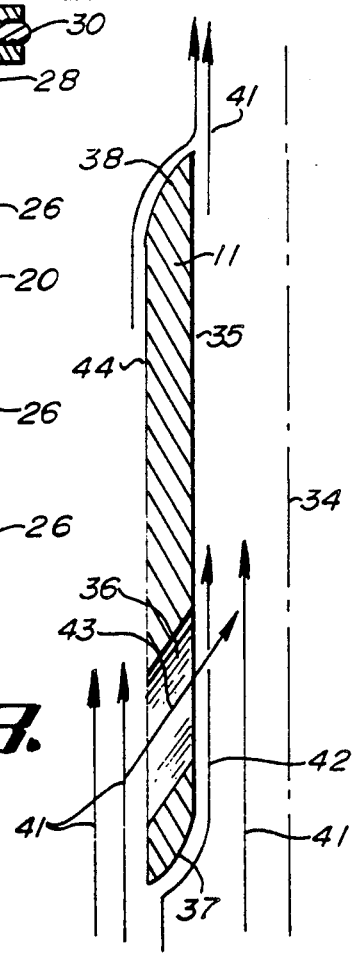
FIG. 4(*a*) is a cross sectional view taken along line IV—IV of FIG. 2.
Figure 4C:
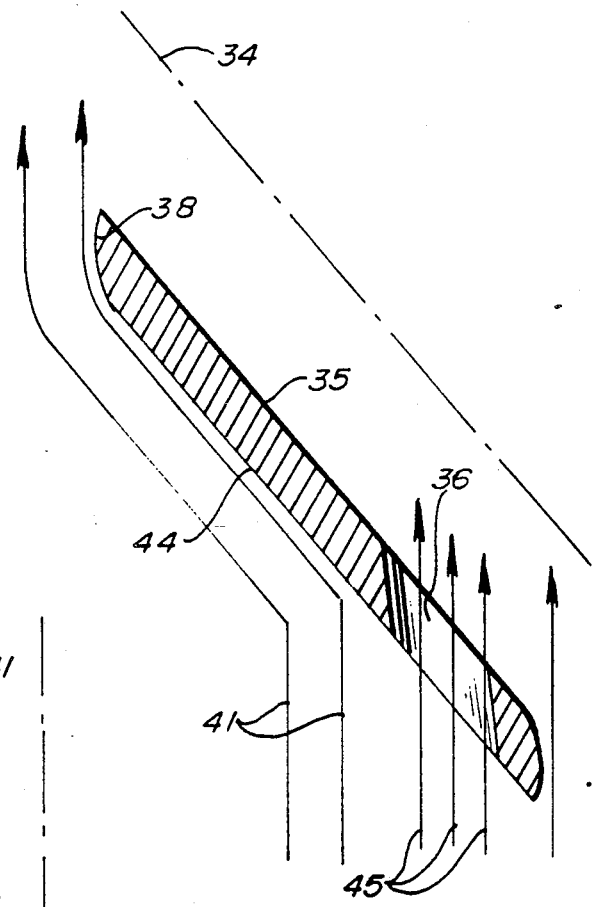
Figure 4A:
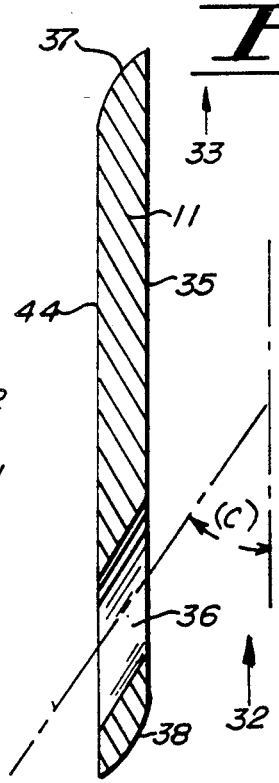

As shown in FIG. 4(*a*), the interior surface 35 of the ring 11, at the inlet opening thereof is formed with a somewhat rounded tapered end surface 37. Similarly, the exterior surface 44 of the ring 11 at the outlet end thereof is shaped with a taper 38 therein.

The prop guard 10 is attached to a motor 13 by locating attachment plate 18 against the bottom surface of cavitation plate 16 and bolting the attachment plate 18 thereto by bolts 39 passing through openings 19. The side plates 22 are then bolted by bolts 40 to the lower fin 17 of the motor 13.

As best shown in FIG. 4(*b*), the prop guard 10 when in operation, is generally oriented to allow water to pass along the longitudinal axis 34 thereof (as shown by lines 41). End surface 37 of ring 11 is shaped so as to cause water flowing there against, such as represented by line 42, to be diverted to flow along interior surface 35. Because line 42 has been diverted. As is well known in fluid dynamics, the diversion of water flow as represented by line 42 causes the speed of fluid represented by line 42 to be increased. This in turn causes a vacuum effect through port 36. The vacuum effect generated in port 36 causes water to be drawn from the exterior surface 44 of ring 11, through port 36 and into the interior thereof (as shown by flow line 43).

The net effect of surface 37 and ports 36 on the water flowing therepast is to draw a portion of the water from the exterior 44 of the ring 11 into the interior area of the ring 11 where it can impinge upon the propeller 14, thus increasing the thrust capability of the motor 13.

As shown in FIG. 4(*c*), when the motor 13 is moving at a velocity through the water, and the propeller is rotated relative to the flow of water in order to effect a turn, it can be seen that water flow lines 41 will impinge upon exterior surface 44 of the ring 11, and be diverted over end surface 38.

In prior art prop guards, when the propeller is rotated to effect a turn, water is deflected away the propeller by the exterior surface of the ring. However, in the present invention, rotation of the propeller 14 to effect a turn causes ring 11 to orient a plurality of the ports 36 (those ports 36 lying directly in line with the water flow lines 45) to be oriented such that water can flow directly through ports 36 and into the blades 16 of the propeller 14, without interference from the ring 11.

Prior art prop guards completely inhibit flow of water directly into the propeller during a turn such as shown by FIG. 4(*c*), and therefore cause cavitation in the area of the propeller. The cavitation causes a loss of thrust of the motor which in turn causes a loss of steering control.

The design of the present invention, including the ports 36, insures that a flow of water is always directed into the propeller 14; even while effecting sharp turns at high speeds. Thus, the problem of prior art prop guards creating cavitation at the propeller thereof during turns has been solved in the design of the present invention.

The prop guard of the present invention has been tested to verify the performance characteristics thereof during actual use. In a first test, a 115 hp outboard engine was fitted with a 19 pitch stainless steel propeller. The motor was attached to a boat and run at top speed (with throttle wide open) and reached a speed of 37 mph at 5500 rpms. The prop guard of the present invention was then attached to the motor and the motor was again run to top speed. The top speed of the motor including the prop guard attached thereto was 36 mph at 5250 rpms. The prop guard of the present invention was then removed and replaced with a prior art prop guard. Top speed of the motor with the prior art prop guard attached thereto was 30 mph at 4800 rpm.

A second series of tests were performed using the prop guard of the present invention. In this test, a 115 hp outboard motor with a 15 pitch aluminum prop was fitted with a ring similar to ring 11 of the present invention, however without any ports 36 extending therethrough and without any tapering of the front or rear end surfaces 37 and 38 thereof. The motor was run at full throttle and reached 29 mph at 5000 rpms.

Next, the ring 11 was tapered at the rear end surface 38 thereof, in the manner as described in the disclosure, and the motor was again run at full throttle. The motor reached 30 mph at 5300 rpms.

Next, the ring 11 was tapered at the front end 37 thereof, and the motor was run at full throttle. The motor reached 32 mph at 5000 rpms.

Next, the ports 36 were drilled in the ring 11 at the angle as described above in the disclosed, and the motor was again run at full throttle. The motor reached 34 mph at 5750 rpms. The prop guard was then completely removed from the motor and the motor was run at full throttle and reached a speed of 35 mph at 5750 rpms.

A third test was conducted to determine the period of time necessary to cause the boat to come to a level position from a starting position dead in the water, to an ending point at top speed. Using a 19 pitch stainless prop with the 115 hp outboard motor, and the prop guard 10 of the present invention, the average time to level the boat was 15 seconds. Without the prop guard 10, the average time to level the boat was 17.6 seconds. The test therefore showed that the prop guard 10 of the present invention helped the boat come to a level position more quickly than without its use. This is important because the boat operators visibility is impaired until the boat reaches a level position. Further, a quicker leveling of the boat allows the boat to be used to pull water skiers with greater ease.

As has also been shown there is very little power loss with the pro guard 10 of the present invention attached to the motor. Further, the control and handling of the boat with the prop guard of the present invention is easier since cavitation is greatly reduced or eliminated, especially during hard turns.

In actual use, there have been other noted advantages of the present invention. For example in very choppy water, the prop guard 10 eliminates keel waking, thereby aiding in keeping the boat under control. Also, as shown by the tests above, with the use of the present invention it is possible to achieve similar top speeds from either a 15 pitch propeller or a 19 pitch propeller. This allows the use of a lower pitch prop (which has the advantages of higher power when accelerating from a dead stop) yet allows the prop nevertheless to retain a good top end speed (such as is generally the purpose of a higher pitched prop). In other words, use of the prop guard of the present invention allows a lower pitched prop to take on the characteristic of a more elaborate (and expensive) two speed prop.

It is to be understood that the above described embodiment is only illustrative of the application of the principles of the present invention. Numerous modifications or alternative arrangements or embodiments may be devised by those skilled in the art without departing from the spirit and scope of the present invention.

I claim:

1. A propeller guard useful in combination with a boat motor said propeller guard comprising:

ring means of generally cylindrical shape surrounding a propeller of the motor, said ring means defining an inlet opening and an outlet opening and a longitudinal axis therethrough, and including an interior surface and an exterior surface located parallel to each other along said longitudinal axis, said interior surface forming an arcuate tapered end surface at said inlet opening, port means including a plurality of ports formed in and uniformly spaced around said ring means for allowing fluid flow between said exterior and interior surfaces, each of said ports being generally cylindrical in shape and including its own longitudinal axis therethrough, whereby said longitudinal axis of each of said ports intersects said longitudinal axis of said ring means at an angle less than 90°, and means for attaching said ring means to the motor, whereby when said propeller guard is attached to the motor and moving through water such that water is entering said inlet opening and exiting said outlet opening, said arcuate tapered end surface causes water impinging thereon to be diverted along said interior surface and to be accelerated in speed relative to water flowing along said exterior surface, causing a vacuum-effect which draws water through said port means into said ring.

2. A propeller guard according to claim 1, wherein said attachment means further includes an attachment plate which is formed as an integral part of said ring means, and which is located at a position diametrically opposed to said attachment bracket.

3. A propeller guard according to claim 2, wherein said attachment plate is slightly concave.

4. A propeller guard according to claim 1 wherein said exterior surface at said inlet opening is substantially parallel with said longitudinal axis of said ring means.

* * * * *